US008918041B2

(12) United States Patent
Kobashigawa

(10) Patent No.: US 8,918,041 B2
(45) Date of Patent: Dec. 23, 2014

(54) FIXING DEVICE INCLUDING A BELT HOLDER CONFIGURED TO MAINTAIN A SHAPE OF A FIXING BELT AND IMAGE FORMING APPARATUS INCORPORATING SAME

(75) Inventor: Shota Kobashigawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 317 days.

(21) Appl. No.: 13/433,926

(22) Filed: Mar. 29, 2012

(65) Prior Publication Data

US 2012/0288308 A1 Nov. 15, 2012

(30) Foreign Application Priority Data

May 9, 2011 (JP) ..... 2011-104018

(51) Int. Cl.
*G03G 15/20* (2006.01)

(52) U.S. Cl.
CPC .... *G03G 15/2017* (2013.01); *G03G 2215/2041* (2013.01); *G03G 2215/2035* (2013.01); *G03G 15/2057* (2013.01); *G03G 15/2053* (2013.01)
USPC ..... 399/329; 399/333; 430/124.32

(58) Field of Classification Search
CPC ..... G03G 15/2053
USPC ..... 399/329; 430/124.32
See application file for complete search history.

(56) References Cited

U.S. PATENT DOCUMENTS

| | | | | |
|---|---|---|---|---|
| 3,869,612 | A * | 3/1975 | Lenhard | 250/319 |
| 3,997,790 | A * | 12/1976 | Suzuki et al. | 250/319 |
| 5,602,635 | A * | 2/1997 | Domoto et al. | 399/328 |
| 8,639,169 | B2 * | 1/2014 | Cao et al. | 399/329 |
| 8,783,857 | B2 * | 7/2014 | Roof et al. | 347/104 |
| 2004/0008979 | A1 * | 1/2004 | Eskey | 392/417 |
| 2008/0232871 | A1 * | 9/2008 | Jung et al. | 399/329 |
| 2009/0208264 | A1 * | 8/2009 | Fujiwara et al. | 399/329 |
| 2010/0303524 | A1 * | 12/2010 | Cao et al. | 399/329 |
| 2011/0116822 | A1 * | 5/2011 | Takenaka et al. | 399/69 |
| 2014/0161497 | A1 * | 6/2014 | Lee et al. | 399/329 |

FOREIGN PATENT DOCUMENTS

| | | | |
|---|---|---|---|
| JP | 11065351 | A | 3/1999 |
| JP | 2006-267941 | A | 10/2006 |
| JP | 2008146010 | A | 6/2008 |
| JP | 2008158398 | A | 7/2008 |

* cited by examiner

*Primary Examiner* — David Gray
*Assistant Examiner* — Geoffrey Evans
(74) *Attorney, Agent, or Firm* — Harness, Dickey & Pierce, P.L.C.

(57) ABSTRACT

A fixing device includes a flexible fuser belt, a stationary, tubular belt holder, a heater, a stationary fuser pad, and a rotatable pressure member. The flexible fuser belt is looped into a generally cylindrical configuration for rotation in a circumferential, rotational direction thereof. The tubular belt holder is inside the loop of the fuser belt to retain the belt in shape during rotation. The heater is inside the belt holder to emit infrared radiation for heating the belt. The fuser pad is inside the loop of the fuser belt. The pressure member is opposite the fuser pad with the fuser belt interposed between the fuser pad and the pressure member. The pressure member presses against the fuser pad through the fuser belt to form a fixing nip therebetween. The belt holder has an infrared-transmissive portion at least where the belt holder faces the heater.

20 Claims, 4 Drawing Sheets

FIXING DEVICE INCLUDING A BELT HOLDER CONFIGURED TO MAINTAIN A SHAPE OF A FIXING BELT AND IMAGE FORMING APPARATUS INCORPORATING SAME

CROSS-REFERENCE TO RELATED APPLICATION

This patent application claims priority pursuant to 35 U.S.C. §119 to Japanese Patent Application No. 2011-104018, filed on May 9, 2011, the entire disclosure of which is hereby incorporated by reference herein.

BACKGROUND OF THE INVENTION

1. Technical Field

The present invention relates to a fixing device and an image forming apparatus incorporating the same, and more particularly, to a fixing device that fixes a toner image in place on a recording medium with heat and pressure, and an electrophotographic image forming apparatus, such as a photocopier, facsimile machine, printer, plotter, or multifunctional machine incorporating several of these features, that incorporates the fixing device.

2. Background Art

In electrophotographic image forming apparatuses, such as photocopiers, facsimile machines, printers, plotters, or multifunctional machines incorporating several of these features, an image is formed by attracting developer or toner particles to a photoconductive surface for subsequent transfer to a recording medium such as a sheet of paper. After transfer, the imaging process is followed by a fixing process using a fixing device, which permanently fixes the toner image in place on the recording medium with heat and pressure.

In general, a fixing device employed in electrophotographic image formation includes a pair of generally cylindrical looped belts or rollers, one being heated for fusing toner ("fuser member") and the other being pressed against the heated one ("pressure member"), which together form a heated area of contact called a fixing nip. As a recording medium bearing a toner image thereupon enters the fixing nip, the fuser member heats the recording medium to fuse and melt the toner particles, while the pressure member presses the recording medium against the fuser member to fix the molten toner onto the recording medium.

Various methods have been proposed to provide a fast, high-quality fixing process that can process a toner image with short warm-up time and first-print time without causing image defects even at high processing speeds.

For example, there is known a belt-based fixing device that employs a pair of opposed rotary members, one being a fuser belt looped into a generally cylindrical configuration, and the other being a generally cylindrical, rotatable pressure member, pressed against each other to form a fixing nip therebetween, through which a recording medium is conveyed under heat and pressure. The fixing device also includes a fuser pad inside the loop of the fuser belt to support pressure from the pressure member, which may be reinforced with a reinforcing member for protection against deformation or displacement under nip pressure.

According to this method, the fuser belt is equipped with a tubular piece of thermally conductive metal, or heat pipe, disposed inside the loop of the fuser belt for heating the fuser belt through conduction. The heat pipe has a heater disposed inside its tubular body, from which heat is imparted to the entire circumference of the fuser belt looped around the heat pipe.

Although generally successful in terms of start-up performance, the fixing device depicted above cannot meet ever-increasing requirements for accelerated warm-up time and first-print time while maintaining low power consumption, as is demanded of today's high-speed imaging equipment.

SUMMARY OF THE INVENTION

Exemplary aspects of the present invention are put forward in view of the above-described circumstances, and provide a novel fixing device.

In one exemplary embodiment, the fixing device includes a flexible fuser belt, a stationary, tubular belt holder, a heater, a stationary fuser pad, and a rotatable pressure member. The flexible fuser belt is looped into a generally cylindrical configuration for rotation in a circumferential, rotational direction thereof. The tubular belt holder is positioned inside the loop of the fuser belt to retain the belt in shape during rotation. The heater is located inside the belt holder to emit infrared radiation for heating the belt. The fuser pad is disposed inside the loop of the fuser belt. The pressure member is provided opposite the fuser pad with the fuser belt interposed between the fuser pad and the pressure member. The pressure member presses against the fuser pad through the fuser belt to form a fixing nip therebetween, through which a recording medium is conveyed under heat and pressure. The belt holder has an infrared-transmissive portion at least where the belt holder faces the heater to transmit at least partially the infrared radiation from the heater to the fuser belt.

Other exemplary aspects of the present invention are put forward in view of the above-described circumstances, and provide an image forming apparatus incorporating a fixing device.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
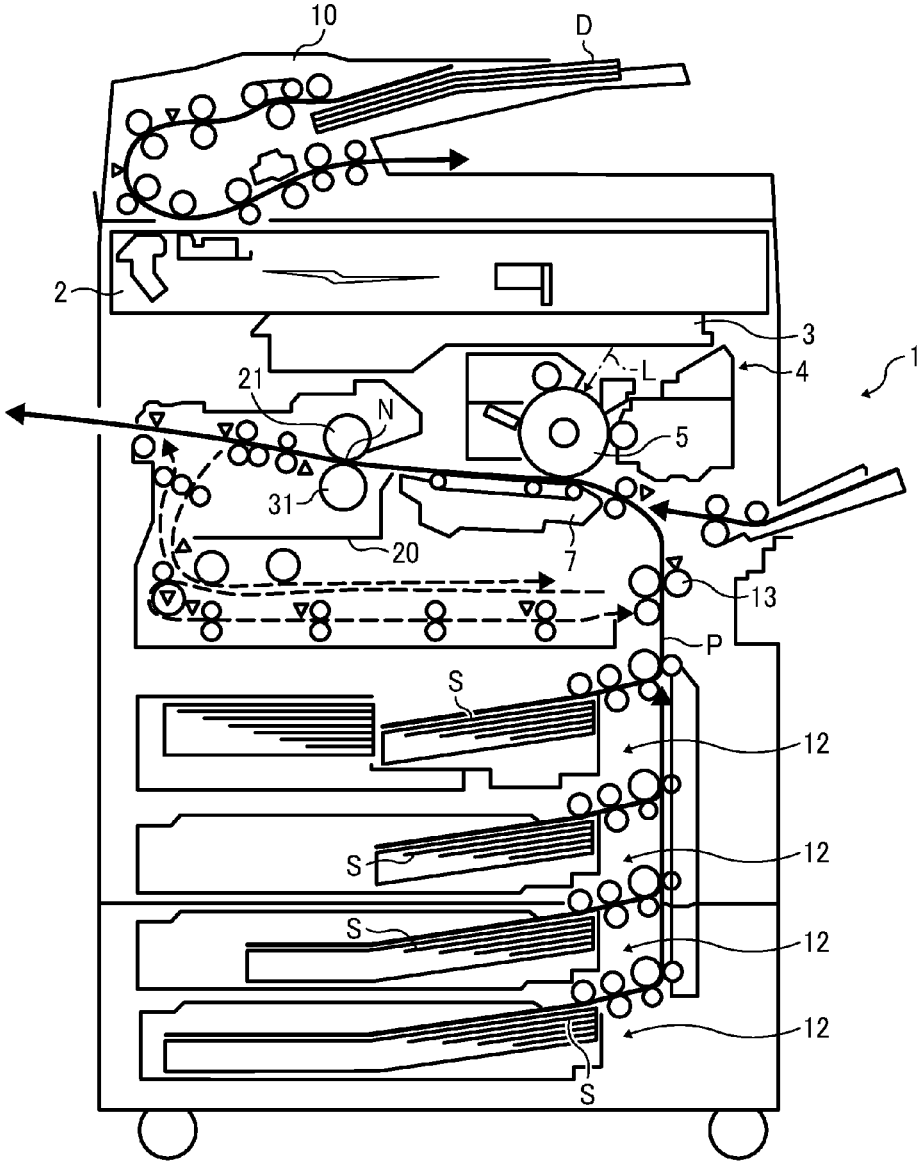
FIG. 1 schematically illustrates an image forming apparatus incorporating a fixing device according to one or more embodiments of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 1 incorporating a fixing device 20 according to one or more embodiments of this patent specification.

As shown in FIG. 1, the image forming apparatus 1 in the present embodiment comprises an electrophotographic photocopier including an image scanner 2 for optically capturing information from an original document D; an exposure device 3 that generates a beam of light L, such as a laser beam, according to the image information output from the image scanner 2; an imaging unit 4 including a drum-shaped photoconductor 5 which is exposed to the laser beam L to create an electrostatic latent image thereon for subsequent development using toner; a transfer unit 7 for transferring the toner image from the photoconductive surface to a recording medium such as a sheet of paper S.

Also included in the image forming apparatus 1 are an automatic document feeder 10 located above the image scanner 2, which includes multiple feed rollers for automatically feeding a user-input document D for optical scanning; one or more input trays 12 each accommodating a stack of recording sheets S; and a pair of registration rollers 13 and various conveyor members, such as guide plates and rollers, which together define a media conveyance path P along which the recording sheet S is conveyed from the input tray 12, through the registration roller pair 13 to the transfer unit 7, and then to the fixing device 20.

Located along the media conveyance path P, the fixing device 20 includes a pair of opposed fixing members 21 and 31, the former being an endless, fuser belt and the latter being a pressure roller, pressed against each other to form a fixing nip N therebetween. Specific configurations of the fixing device 20 and its associated structure will be described later in more detail with reference to FIG. 2 and subsequent drawings.

During operation, to reproduce a copy of a user-input document D, the automatic document feeder 10 rotates the feed rollers to feed the original document D downward toward the image scanner 2. As the document D proceeds, the image scanner 2 scans the surface of the document D to obtain image information, which is converted into electrical data signals for subsequent transmission to the exposure device 3. The exposure device 3 then irradiates the surface of the photoconductor 5 with a laser beam L modulated according to the image data signals.

In the imaging unit 4, the photoconductive drum 5 rotates in a given rotational direction (clockwise in the drawing) to undergo a series of electrophotographic processes, including charging, exposure, and development processes, in which the drum 5 has its outer, photoconductive surface initially charged to a uniform potential, and then exposed to the laser beam L to create an electrostatic latent image thereon, followed by developing the latent image into a visible toner image with toner.

Meanwhile, the media conveyance mechanism picks up an uppermost one of the stacked sheets S in one of the input trays 12 (for example, that situated highest of the four input trays), selected either automatically or manually by the user, and feeds it into the media conveyance path P. The fed sheet S first reaches between the pair of registration rollers 13, which hold the incoming sheet S therebetween, and then advance it in sync with the movement of the photoconductive drum 5 toward the transfer device 7, at which the developed toner image is transferred from the photoconductive surface to the recording sheet S.

After transfer, the recording sheet S is introduced into the fixing device 20. In the fixing device 20, the recording sheet S passes through the fixing nip N, at which the toner image is fixed in place on the sheet S under heat from the fuser belt 21 and pressure between the opposed members 21 and 31. Upon exiting the fixing nip N, the recording sheet S is directed outside the apparatus body for user pickup, which completes one operational cycle of the image forming apparatus 1.

Figure 2:
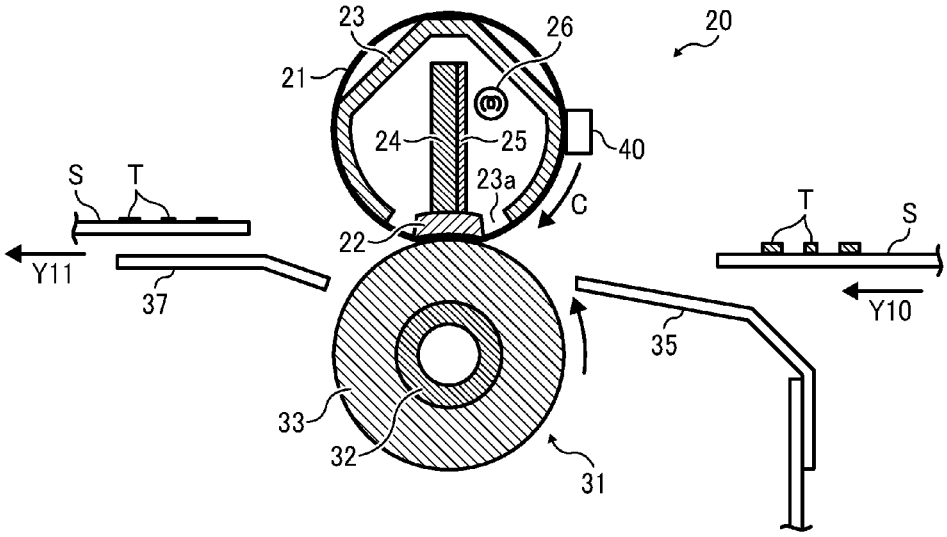
FIG. 2 is an end-on, axial cutaway view of the fixing device according to one or more embodiments of this patent specification.

FIG. 2 is an end-on, axial cutaway view of the fixing device 20 according to one or more embodiments of this patent specification.

As shown in FIG. 2, the fixing device 20 includes an internally heated, flexible fuser belt 21 looped into a generally cylindrical configuration for rotation in a circumferential, rotational direction C; a stationary fuser pad 22 inside the loop of the fuser belt 21; and a rotatable, pressure roller 31 opposite the fuser pad 22, with the fuser belt 21 interposed between the fuser pad 22 and the pressure roller 31. The pressure roller 31 presses against the fuser pad 22 through the fuser belt 21 to form a fixing nip N therebetween, through which a recording sheet S is conveyed in a conveyance direction Y under heat and pressure.

Also included in the fixing device 20 are a stationary, tubular belt holder 23 inside the loop of the fuser belt 21 to retain the belt 21 in shape during rotation, and a heater 26 inside the belt holder 23 to emit infrared radiation for heating the belt 21. A stationary reinforcing member 24 is disposed in contact with the fuser pad 22 inside the belt holder 23 to reinforce the fuser pad 22 against pressure from the pressure roller 31. Also, a reflector or reflective surface 25 may be provided inside the belt holder 23 at a location other than between the heater 26 and the belt holder 21 to reflect at least some of the infrared radiation from the heater 26 toward the belt holder 23.

Figure 3:
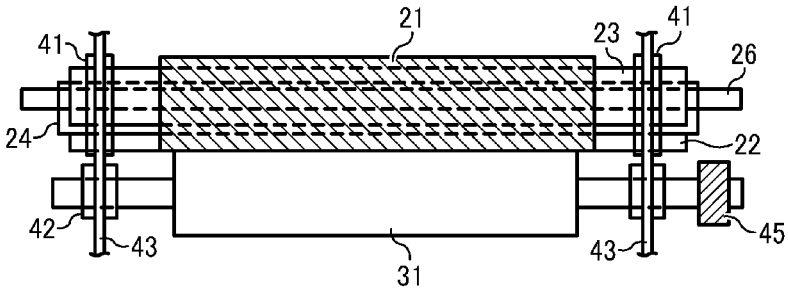
FIG. 3 is a top plan view of the fixing device of FIG. 2.

With additional reference to FIG. 3, which is a top plan view of the fixing device 20 of FIG. 2, the fuser belt 21 and the pressure roller 31 are shown extending in an axial, longitudinal direction perpendicular to the conveyance direction Y between a pair of sidewalls 43. Components disposed inside the loop of the fuser belt 21, including the fuser pad 22, the belt holder 23, the reinforcing member 24, the reflector 25, and the heater 26, also extend in the axial direction with their respective longitudinal ends secured to the sidewalls 43 with a pair of retaining members 41, which hold the elongated components stationary in position in the fixing device 20.

The term "stationary" or "disposed stationary" as used herein refers to those components of the fixing device 20 which remain still and do not move or rotate as the pressure member and the fuser belt rotate during operation of the fixing device. Hence, a stationary member may still be subjected to mechanical force or pressure resulting from its intended use (e.g., the stationary fuser pad pressed against the pressure member by a spring or biasing member), but only to an extent that does not cause substantial movement, rotation, or displacement of the stationary member.

During operation, upon activation of the image forming apparatus 1, power supply circuitry starts supplying electricity to the heater 26, which converts electricity into infrared radiation for emission toward the fuser belt 21, while a rotary drive motor activates the pressure roller 31 to rotate counterclockwise in the drawing, which induces a frictional force to in turn rotate the fuser belt 21 in the rotational direction C around the belt holder 23.

Power supply to the heater 26 may be computer-controlled according to readings of a thermometer 40, such as a thermistor, disposed adjacent to the fuser belt 21 to detect a temperature at an outer circumferential surface of the fuser belt 21, so as to heat the fixing nip N to a given processing temperature sufficient for processing toner particles in use.

Then, a recording sheet S bearing an unfixed, powder toner image T, formed through the electrophotographic imaging processes as described above, enters the fixing device 20. As the fuser belt 21 and the pressure roller 31 rotate together, the recording sheet S moves in the conveyance direction Y10 along an upstream guide member 35 to enter the fixing nip N, with its front, printed face brought into contact with the fuser belt 21 and bottom face into contact with the pressure roller 31.

At the fixing nip N, the fuser belt 21 heats the incoming sheet S to fuse and melt the toner particles, while the pressure roller 31 presses the sheet S against the fuser pad 22 to fix the molten toner onto the sheet surface. After fixing, the recording sheet S exits the fixing nip N in the conveyance direction Y11 along a downstream guide member 36 for further conveyance to a subsequent destination.

In the present embodiment, the fuser belt 21 comprises an endlessly looped belt of thin, flexible material. In its looped, generally cylindrical configuration, the fuser belt 21 may, for example, have an outer diameter of approximately 30 mm. With additional reference to FIG. 4, which is an enlarged, partial cross-sectional view of the fuser belt assembly, the fuser belt 21 is shown consisting of a substrate 21*a*, upon which an intermediate layer 21*b* and an outer coating 21*c* are deposited one upon another to form a multilayered structure, approximately 1 mm or less in thickness. The substrate 21*a* faces an interior of the loop, and the outer coating 21*c* faces an exterior of the loop.

More specifically, the substrate 21*a* of the belt 21 may be formed of a suitable material, such as colorless, transparent polyimide, approximately 30 μm to approximately 50 μm thick. The intermediate layer 21*b* of the belt 21 may be formed of rubber, such as solid or foamed silicone rubber, fluorine resin, or the like, approximately 100 μm to approximately 300 μm thick on the substrate 21*a*. The outer coating 21*c* of the belt 21 may be formed of a release agent, such as tetra fluoro ethylene-perfluoro alkylvinyl ether copolymer or PFA, polyimide (PI), polyetherimide (PEI), polyethersulfide (PES), or the like, approximately 10 μm to approximately 50 μm thick on the intermediate layer 21*b*.

The intermediate elastic layer 21*b* serves to accommodate minute variations in applied pressure to maintain a smooth belt surface at the fixing nip N, which ensures uniform distribution of heat across a recording sheet S to yield a resulting image with a smooth, consistent appearance. The release coating layer 21*c* provides good stripping of toner from the belt surface to ensure reliable conveyance of recording sheets S through the fixing nip N.

The tubular belt holder 23 comprises a generally cylindrical, longitudinally slotted tube or pipe with a wall thickness of approximately 100 μm to approximately 300 μm. The belt holder 23 defines a longitudinal slot 23*a* on its one side for accommodating the fuser pad 22 therein, such that an outer circumferential surface of the belt holder 23 faces an inner circumferential surface of the belt 21 over the entire length of the belt 21 except at the fixing nip N.

The fuser pad 26 comprises an elongated piece extending inside the tubular belt holder 23 to contact the pressure roller 31 via the fuser belt 12 at the fixing nip N. The fuser pad 26 has a contact surface defined on its front side to face the pressure roller 31, which is slightly concave to accommodate the curvature of the pressure roller 31. Such a configuration allows the contact surface to readily conform to the circumferential surface of the pressure roller 31, which prevents the recording sheet S from adhering to or winding around the fuser belt 21 upon exiting the fixing nip N, leading to reliable conveyance of the recording sheet S after fixing process.

The fuser pad 26 is formed of a sufficiently rigid material to prevent deformation or bending under pressure from the pressure roller 31. Also, for preventing abrasion of the fuser belt 21 due to sliding against the fuser pad 22, the contact surface of the fuser pad 26 is formed of anti-friction material with a sufficiently low coefficient of friction.

The heater 26 comprises an elongated, infrared radiant heating element, such as a halogen heater, extending inside the tubular belt holder 23 to emit infrared light rays toward the fuser belt 21 via the belt holder 23. For example, the heater 26 may be a halogen lamp that converts electricity into infrared radiation at a wavelength of 1.5 μm with an efficiency of 85% or greater. Providing the heater 26 within the belt holder 23 inside the loop of the fuser belt 21, compared to a heat source positioned outside the belt loop, allows for a more compact fuser assembly.

The reinforcing member 24 comprises an elongated piece of rigid material, dimensioned to be accommodated inside the loop of the fuser belt 21, having a length substantially equal to that of the fuser pad 22, and a width extending parallel to a direction in which the pressure roller 31 exerts pressure against the fuser pad 22. The reinforcing member 23 serves to support pressure from the pressure roller 31 through the fuser pad 22 and the fuser belt 21, so as to prevent the fuser pad 22 from significant deformation under pressure at the fixing nip N. For effective reinforcement of the fuser pad 22, the reinforcing member 23 may be formed of sufficiently rigid metallic or nonmetallic material, such as iron, stainless steel, ceramic, or the like.

The reflector 25 comprises a reflective plate or membrane provided on a surface of the reinforcing member 24 facing the heater 26 so as not to intervene between the heater 26 and the belt holder 23 inside the belt holder 23, defining a reflective surface that can reflect at least some of the infrared radiation from the heater 26 toward the belt holder 23. Provision of the reflector 25 promotes thermal efficiency in radiant heating the fuser belt 21, in that any radiation emitted toward the reinforcing member 24 is reflected off the reflective surface toward the belt holder 23 and eventually to the fuser belt 21. For effective reflection of electromagnetic radiation, in particular, infrared radiation, the reflector 25 may be formed of plated or vapor-deposited coatings of metal, such as gold, silver, aluminum, or the like.

The pressure roller 31 comprises a motor-driven, elastically biased cylindrical body formed of a hollowed core 32 of metal, covered with an elastic layer 33 of elastic material, such as sponged or solid silicone rubber, fluorine rubber, or the like. An additional, thin outer layer of a release agent, such as PFA, PTFE, or the like, may be deposited upon the elastic layer 33. The pressure roller 31 is equipped with a suitable biasing mechanism that elastically presses the cylindrical body against the fuser belt assembly.

With specific reference to FIG. 3, a gear 45 is shown provided to a shaft of the pressure roller 31 for connection to a gear train of a driving mechanism that imparts a rotational force or torque to rotate the cylindrical body. A pair of bearings 42 is provided to the longitudinal ends of the pressure roller 31 to rotatably hold the roller 31 in position on the sidewalls 43 of the fixing device 20. Optionally, the pressure roller 31 may have a dedicated heater, such as a halogen heater, accommodated in the hollow interior of the metal core 32.

In the present embodiment, the pressure roller 31 is approximately 30 mm in diameter, which equals the diameter of the fuser belt 21 in its looped, generally cylindrical configuration. Alternatively, instead, the fuser and pressure members may be configured as generally cylindrical bodies of different diameters. For example, the fuser belt 21 may be dimensioned smaller in diameter than the pressure roller 31, so that the belt 21 exhibits a greater curvature of radius than that of the pressure roller 31 along the fixing nip N, which allows for ready separation of a recording sheet S from the belt surface at the exit of the fixing nip N.

The upstream and downstream guide members 35 and 37 comprise plates of any suitable configuration that can guide a recording sheet S for entry into and exit from the fixing nip N, respectively. The guide plates 35 and 37 are disposed stationary by being secured to the sidewalls 43 of the fixing device 20.

Figure 4:
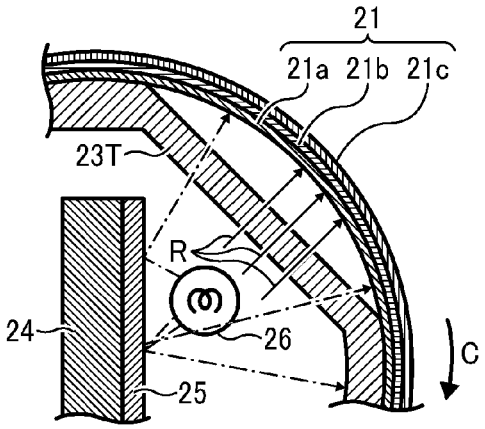
FIG. 4 is an enlarged, partial cross-sectional view of a fuser belt assembly included in the fixing device of FIG. 2.

With specific reference to FIG. 4, the tubular belt holder 23 according to this patent specification is shown having an infrared-transmissive portion 23T defined at least where the belt holder 23 faces the heater 26 to transmit at least some of the infrared radiation from the heater 26 to the fuser belt 21, as indicated by arrows R in the drawing. That is, the belt holder 23 is transparent or translucent to infrared light at least where it lies adjacent or closest to the heater 26, so that the infrared rays R radiated from the heater 26, in whole or in part, can pass through the belt holder 23 to reach the fuser belt 21.

In the present embodiment, the infrared-transmissive portion 23T comprises the entire body of the belt holder 23. The belt holder 23 exhibits an infrared transmittance of approximately 80% or more at a wavelength of, for example, 1.5 μm, which corresponds to the wavelength of infrared radiation from the heater 26. Examples of suitable infrared-transmissive material include, but are not limited to, heat-resistant glass such as quartz glass, and resin such as polyimide.

Providing the tubular belt holder 23 with transparency or translucency to infrared radiation promotes direct transfer of energy from the heater 25 to the fuser belt 21, which allows for efficient radiant heating of the fuser belt 21. High heating efficiency of the fuser belt 21 results in short warm-up time and first-print time required to process an initial print job upon start-up, as well as reduced power consumed for heating the belt to a desired temperature during operation of the fixing device 20.

Further, in the present embodiment, the infrared-transmissive portion 23T of the belt holder 23 is at least partially spaced apart from the fuser belt 21.

Figure 5:
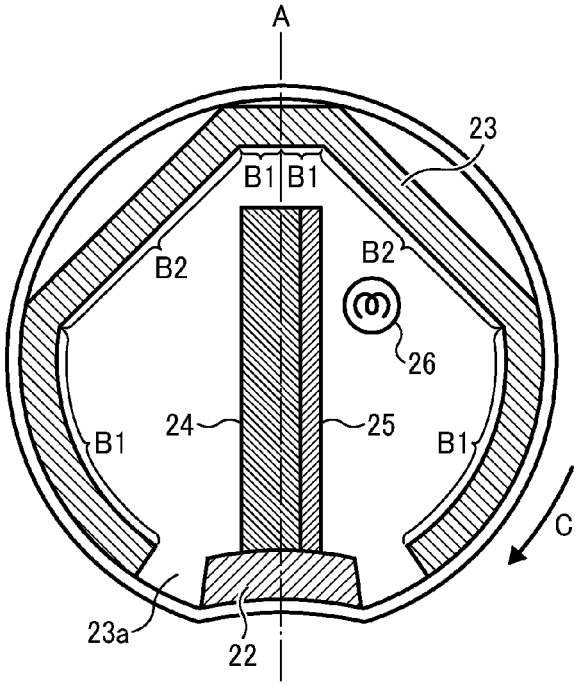
FIG. 5 is an enlarged view of an interior structure of the fuser belt assembly.

More specifically, with additional reference to FIG. 5, which is an enlarged view of the interior structure of the fuser belt assembly, the belt holder 23 is shown divided into two substantially symmetrical halves by an imaginary, central plane A passing through a central longitudinal axis of the tubular holder 23. Each of the two halves of the holder 23 defines, along its outer circumferential surface, one or more first, contact sections B1 in contact with the belt 21, and one or more second, non-contact sections B2 separate from the belt 21 and interposed between the first sections B1. In the present embodiment, a total area of the first sections B1 is larger than that of the second sections B2. The belt holder 23 may be divided by a central plane A extending along the reinforcing member 24, i.e., parallel to the direction of pressure from the pressure member 31, as shown in FIG. 5, with each half of the belt holder 23 having two contact sections B1 loosely touching the belt 21 and an intervening non-contact section B2 spaced apart from the belt 21.

Provision of the non-contact sections B2 in the belt holder 23 reduces an amount of heat lost through conduction from the fuser belt 21 to the belt holder 23, thus increasing thermal efficiency in radiant heating of the fuser belt 21. Moreover, symmetrical positioning of the non-contact sections B2 between the contact sections B1 allows the belt holder 23 to effectively retain the flexible belt 21 in its generally cylindrical configuration without interfering with stable, smooth movement of the belt 21 in the rotational direction C.

With still continued reference to FIG. 5, of the two halves of the belt holder 23, the heater 26 is disposed adjoining the one that is upstream from the fixing nip N in the circumferential, rotational direction C of the fuser belt 21. Note that the heater 26 is located closer to the non-contact section B2 than to the contact sections B1 of the belt holder 23. Such location of the heater 26 allows more infrared radiation to reach the fuser belt 21 through the non-contact section B2 than through the contact sections B1 of the infrared-transmissive belt holder 23. The infrared energy transmitted through the non-contact section B2 can more effectively contribute to heating of the fuser belt 21 than that transmitted through the contact sections B1, since the former is less vulnerable to being dispersed into the belt holder 23 than the latter.

Thus, provision of the partial spacing between the infrared-transmissive portion 23T of the belt holder 23 and the fuser belt 21 results in increased thermal efficiency in radiant heating of the fuser belt 21. Further, positioning the heater 26 adjacent to where the infrared-transmissive portion 23T is spaced apart from the fuser belt 21 leads to more effective radiant heating of the fuser belt 21, as it prevents amounts of infrared energy from being lost through conduction from the fuser belt 21 to the belt holder 23.

Still further, in the present embodiment, the infrared-transmissive portion 23T of the belt holder 23 extends upstream from the fixing nip N in the rotational direction C of the fuser belt 21. That is, the belt holder 23, which is formed entirely of an infrared-transmissive material in the present embodiment, can transmit infrared radiation at least where it faces the belt 21 moving toward, rather than away from, the fixing nip N. In such cases, the heater 26 may be positioned adjacent to the upstream half of the belt holder 23 in the rotational direction C of the fuser belt 21. Positioning the infrared-transmissive portion 23T as well as the heater 26 upstream from the fixing nip N allows for effective, timely heating of the fuser belt 21 before entry into the fixing nip N at which the belt 21 imparts heat to a recording sheet S for heating and fusing a toner image T thereon.

The reflector 25 may be selectively positioned relative to the heater 26 inside the belt holder 23, such as, for example, on that side of the reinforcing member 24 facing the heater 26 adjacent to the upstream half of the belt holder 23, so that the reflector 25 can effectively direct incident radiation from the heater 26 toward the belt holder 23 and eventually to the fuser belt 21, resulting in increased thermal efficiency in radiant heating of the fuser belt 21.

Yet still further, in the present embodiment, the fuser belt 21 includes an infrared-transmissive, inner layer facing an interior of the loop to transmit at least some of the infrared radiation from the heater 26, and an infrared-absorptive, outer layer over the infrared-transmissive layer and facing an exterior of the loop to absorb at least some of the infrared radiation from the heater 26.

More specifically, as mentioned earlier, the fuser belt 21 comprises a substrate of polyimide 21*a*, an intermediate layer

21*b* of an elastic material, such as silicone rubber, foamed silicone rubber, or fluorine rubber, overlying the substrate 21*a*, and an infrared-absorptive outer coating 21*c* of a release agent, such as tetra fluoro ethylene-perfluoro alkylvinyl ether copolymer, polyimide, polyetherimide, or polyethersulfide, overlying the intermediate layer, as described earlier with reference to FIG. 4. Of the three layers of the belt 21, the substrate 21*a* may serve as the infrared-transmissive layer, and the intermediate layer 21*b* and the outer coating 21*c* as the infrared-absorptive layer.

For example, the substrate 21*a* may be a transparent polyimide layer that exhibits an infrared transmittance of approximately 80% or more at a wavelength of 1.5 μm. The intermediate layer 21*b* may be a silicone rubber layer that exhibits an infrared absorbance of approximately 90% or more at a wavelength of 1.5 μm. The outer coating 21*c* may be a deposit of PFA, which exhibits a similar infrared absorbance as that of the intermediate layer 21*b*.

With the fuser belt 21 formed of an inner infrared-transmissive layer and an outer infrared-absorptive layer, the infrared radiation, upon reaching the inner circumferential surface of the belt 21 through the infrared-transmissive belt holder 23, can readily penetrate the inner substrate 21*a* for subsequent absorption into the intermediate and outer layers 21*b* and 21*c*. The multilayered structure of the fuser belt 21 thus allows for efficient, selective heating of the outer circumferential surface of the belt 21, which is directly responsible for heating and fusing toner images.

Furthermore, in the present embodiment, the belt holder 23 is isolated from the fuser pad 22 and the reinforcing member 24. That is, the belt holder 23, configured as a longitudinally slotted tube or pipe with the longitudinal slot 23*a* accommodating the fuser pad 22 therein, is separate from the fuser pad 22 and the reinforcing member 24, which are subjected to pressure at the fixing nip N during operation. This arrangement protects the belt holder 23 from substantial bending or deformation during operation, even where the fuser pad 22 and the reinforcing member 24 are slightly deformed and/or displaced due to pressure at the fixing nip N, which would otherwise result in accelerated wear and tear as well as increased torque on the fuser belt due to rubbing against the deformed belt holder. Protection against deformation of the belt holder 23 and concomitant adverse effects on the fuser belt 21 is particularly effective where the belt holder is configured with extremely thin walls to obtain high infrared radiation transmittance.

Experiments were conducted to investigate effects of the infrared-transmissive belt holder on performance of fixing processes employing a radiant-heated fuser belt. In the experiments, two test devices were prepared with different configurations of the tubular belt holder: Device D1 with a belt holder formed of non-infrared-transmissive, thermally conductive metal, and Device D2 with a belt holder formed of infrared-transmissive material, similar to that depicted primarily with reference to FIG. 2. Printing was carried out at a speed of 35 pages per minute. Warm-up time and typical energy consumption (TEC), which is a standardized measurement for power consumed in imaging equipment, were measured for each of the test devices during printing.

Figure 6:
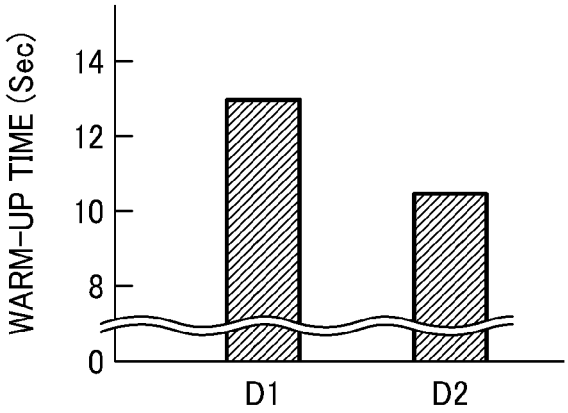
FIG. 6 is a graph showing measurements of warm-up time, in seconds, obtained through experiments.
Figure 7:
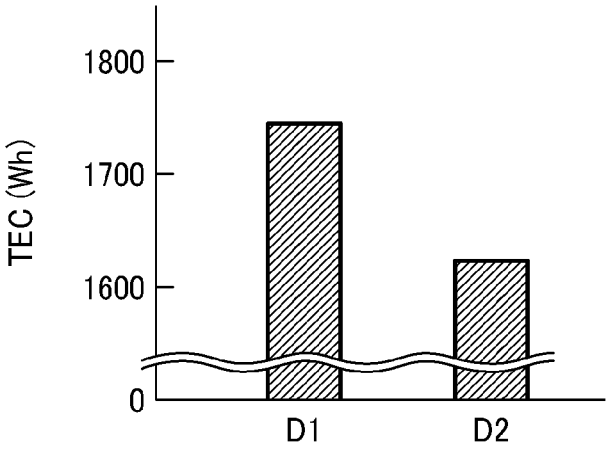
FIG. 7 is a graph showing measurements of typical energy consumption (TEC), in watt-hours (Wh), obtained through the experiments.

FIGS. 6 and 7 are graphs showing measurements of warm-up time, in seconds, and TEC, in watt-hours (Wh), respectively, obtained through the experiments.

As shown in FIG. 6, Device D1 required a warm-up time of approximately 12 seconds or more, whereas Device D2 required a warm-up time of slightly above 10 seconds, yielding a difference of approximately 2.3 seconds. On the other hand, as shown in FIG. 7, the TEC value obtained in Device D1 was well above 1,700 Wh, whereas the TEC value obtained in Device D2 did not reach 1,700 Wh, yielding a difference of approximately 62 Wh. Such experimental results indicate that using an infrared-transmissive belt holder, instead of a conventional, thermally conductive belt holder, results in a reduction in the warm-up time and power consumption in a fixing device employing a radiant-heated fuser belt.

Hence, the fixing device 20 according to this patent specification provides a fast, energy-efficient fixing process that can process a toner image with short warm-up time and first-print time while maintaining low power consumption even in high-speed applications, owing to use of the stationary, tubular belt holder 23 having an infrared-transmissive portion 23T to transmit at least some of the infrared radiation from the heater 26 to the fuser belt 21. The image forming apparatus 1 according to this patent specification also benefits from these and other effects of the fixing device 20 incorporated therein.

Although in several embodiments of this patent specification, the fixing device 20 has been described in specific configurations, the material, shape, position, and number of various components of the fixing device may be configured otherwise than specifically depicted with reference to the drawings. In each of such cases, the fixing device using the infrared-transmissive tubular belt holder produces similar effects as described herein.

For example, instead of a cylindrical roller, the rotary pressure member may be configured as a pressure belt pressing against a fuser member to form a fixing nip therebetween.

Further, instead of a multilayered structure formed of a substrate and overlying layers, the flexible fuser belt may be configured as an endless, monolayer film.

Still further, the fuser pad may be arranged to have a mirror finished or thermally insulated surface where the pad faces the heater inside the belt holder. Such arrangement allows the fuser pad to reflect or insulate radiation from the heater, resulting in an increased amount of heat involved in heating the fuser belt, which allows for more efficient radiant heating of the fuser belt.

Yet still further, instead of a generally cylindrical, longitudinally slotted tube or pipe, the tubular belt holder may be configured as a generally cylindrical, longitudinally closed tube or pipe within which the fuser pad is accommodated, such that an outer circumferential surface of the belt holder faces an entire inner circumferential surface of the belt.

Furthermore, instead of being formed entirely of an infrared-transmissive material, the tubular belt holder may be formed partially of an infrared-transmissive material, and partially of a thermally conductive material. That is, the belt holder may be transparent or translucent to infrared radiation only locally, for example, at the non-contact section closest to the heater in the embodiment of FIG. 5, while allowing conduction of heat to the fuser belt over the rest of its tubular body. Even with such arrangement, the fixing device may have high thermal efficiency and low power consumption owing to provision of the fuser belt with infrared transmissivity adjacent to the heater.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device, comprising:

a flexible fuser belt looped into a generally cylindrical configuration, the belt configured to rotate;

a heater configured to emit infrared radiation for heating the fuser belt;

a stationary tubular belt holder inside the loop of the fuser belt and surrounding the heater, the belt holder configured to retain a shape of the fuser belt during rotation, the belt holder including at least one infrared-transmissive portion in a shape of a chord between two points along the fuser belt such that a gap is formed between the infrared-transmissive portion and the fuser belt, the infrared-transmissive portion configured to transmit at least a portion of the infrared radiation to the fuser belt;

a stationary fuser pad inside the loop of the fuser belt; and a rotatable pressure member opposite the fuser pad with the fuser belt interposed between the fuser pad and the pressure member, the pressure member configured to press against the fuser pad through the fuser belt to form a fixing nip therebetween, through which a recording medium is conveyed under heat and pressure.

2. The fixing device according to claim 1, wherein the infrared-transmissive portion of the belt holder is at least partially spaced apart from the fuser belt.

3. The fixing device according to claim 1, wherein the belt holder is divided into two substantially symmetrical halves by an imaginary plane passing through a central, longitudinal axis thereof, each of which half defines, along its outer circumferential surface, first sections in contact with the belt, and contiguous second sections separate from the belt and interposed between the first sections, with a total area of the first sections being larger than that of the second sections.

4. The fixing device according to claim 1, wherein the infrared-transmissive portion of the belt holder exhibits an infrared transmittance of approximately 80% or more at a wavelength of 1.5 μm.

5. The fixing device according to claim 1, wherein the infrared-transmissive portion of the belt holder is formed of heat-resistant glass or polyimide resin.

6. The fixing device according to claim 1, wherein the infrared-transmissive portion of the belt holder extends upstream from the fixing nip in the rotational direction of the fuser belt.

7. The fixing device according to claim 1, wherein the heater is positioned adjacent to an upstream half of the belt holder in the rotational direction of the fuser belt.

8. The fixing device according to claim 1, wherein the belt holder is formed entirely of an infrared-transmissive material.

9. The fixing device according to claim 1, wherein the belt holder further comprises a portion formed of a thermally conductive material.

10. The fixing device according to claim 1, wherein the belt holder comprises:

a generally cylindrical, longitudinally slotted tube defining a longitudinal slot therein for accommodating the fuser pad therein, such that an outer circumferential surface of the belt holder faces an inner circumferential surface of the belt except at the fixing nip.

11. The fixing device according to claim 1, wherein the belt holder comprises:

a generally cylindrical, longitudinally closed tube with open ends, within which the fuser pad is accommodated, an outer circumferential surface of the belt holder facing an inner circumferential surface of the belt over the entire length of the belt.

12. The fixing device according to claim 1, wherein the fuser belt includes:

an infrared-transmissive inner layer facing an interior of the loop, the infrared-transmissive inner layer configured to transmit at least a portion of the infrared radiation from the heater; and an infrared-absorptive outer layer over the infrared-transmissive layer and facing an exterior of the loop, the infrared-absorptive outer layer configured to absorb at least a portion of the infrared radiation from the heater.

13. The fixing device according to claim 1, wherein the fuser belt comprises:

a substrate of polyimide;

an intermediate layer of an elastic material overlying the substrate, the elastic material being one of silicone rubber, foamed silicone rubber, and fluorine rubber; and an outer coating of a release agent overlying the intermediate layer, the outer coating of the release agent being one of tetra fluoro ethylene-perfluoro alkylvinyl ether copolymer, polyimide, polyetherimide, and polyethersulfide.

14. The fixing device according to claim 1, wherein the fuser belt includes an endless monolayer film.

15. The fixing device according to claim 1, further Comprising:

a reflector inside the belt holder at a position other than between the heater and the belt holder, the reflector configured to reflect at least a portion of the infrared radiation from the heater toward the belt holder.

16. The fixing device according to claim 15, wherein the reflector has a plated or vapor-deposited coating of a material, the material being one of gold, silver, and aluminum.

17. The fixing device according to claim 1, further comprising:

a stationary reinforcing member in contact with the fuser pad inside the belt holder, the reinforcing member configured to reinforce the fuser pad, the reinforcing member defining a reflective surface at least where the reinforcing member faces the heater to reflect at least some of the infrared radiation from the heater toward the belt holder.

18. The fixing device according to claim 1, wherein the fuser pad has a thermally insulated or thermally reflective surface facing the heater inside the belt holder.

19. The fixing device according to claim 1, wherein the heater includes a halogen lamp.

20. An image forming apparatus, comprising:

an imaging unit to form a toner image on a recording medium; and a fixing device to fix the toner image in place on the recording medium, the fixing device including, a flexible fuser belt looped into a generally cylindrical configuration, the belt configured to rotate a heater configured to emit infrared radiation for heating the fuser belt, a stationary tubular belt holder inside the loop of the fuser belt and surrounding the heater, the belt holder configured to retain a shape of the fuser belt, during rotation, the belt holder including at least one infrared-transmissive portion in a shape of a chord such that a gap is formed between the infrared-transmissive portion and the fuser belt, the infrared-transmissive portion configured to transmit at least a portion of the infrared radiation to the fuser belt, a stationary fuser pad inside the loop of the fuser belt, and a rotatable pressure member opposite the fuser pad with the fuser belt interposed between the fuser pad and the pressure member, the pressure member configured to press against the fuser pad through the fuser belt to form a fixing nip therebetween, through which the recording medium is conveyed under heat and pressure.

* * * * *